US005971055A

United States Patent [19]

Rohaut

[11] Patent Number: 5,971,055

[45] Date of Patent: Oct. 26, 1999

[54] ANTI-FALLING SAFETY DEVICE FOR A SHUTTER

[76] Inventor: Serge Rohaut, 13 Chemin Gojousse, Vieille Toulouse, France, 31320

[21] Appl. No.: 09/124,240

[22] Filed: Jul. 29, 1998

[30] Foreign Application Priority Data

Jul. 29, 1997 [FR] France ..... 97.09756

[51] Int. Cl.[6] ..... E06B 9/56

[52] U.S. Cl. ..... 160/300; 49/322

[58] Field of Search ..... 160/300, 301, 160/302, 133, 1, 8, 296; 49/322; 74/411.5, 575, 577 R, 577 S; 188/82.1, 82.7, 82.77

[56] References Cited

U.S. PATENT DOCUMENTS

| | | | |
|---|---|---|---|
| 1,842,123 | 1/1932 | Rush | 160/8 |
| 2,019,085 | 10/1935 | Miller | 160/8 |
| 3,842,892 | 10/1974 | Stieler | 160/300 X |
| 4,112,996 | 9/1978 | Fohl | 160/300 X |
| 4,125,142 | 11/1978 | Fohl | 160/300 X |
| 4,704,914 | 11/1987 | Horng | 160/300 X |
| 5,494,093 | 2/1996 | Eiterman . | |

*Primary Examiner*—David M. Purol
*Attorney, Agent, or Firm*—Young & Thompson

[57] ABSTRACT

Safety device for vertically openable closures provided with a shutter mounted about a fixed tube (1), includes a fixed disc (10) provided with at least one radial opening (16–17), a movable disc (23) driven in rotation with the shutter, at least one blockage element (25–27) articulated on the movable disc (23) and including a free end **(25*a*) of a shape adapted to be able to penetrate and to become blocked in each radial opening (16–17) of the fixed disc (10), and associated with each blockage element (25–27) resilient elements (32) adapted to permit a pivoting of this latter so as to cause its free end (25*a*) to become blocked in a radial opening (16–18)** when the centrifugal force exceeds a given threshold value.

10 Claims, 4 Drawing Sheets

A
A
1
6
7
9
10
11
11a
12
19
20
21
22
23
25
27
28
29
30
31
41

B
B
F
1
6
7
12
14a
15a
16
17
18
20
23
25
25a
26
27
32
33
34
35
40
40a

ANTI-FALLING SAFETY DEVICE FOR A SHUTTER

FIELD OF THE INVENTION

The invention relates to a safety device for vertically opening closures provided with a shutter mounted about a fixed tube, said safety device being adapted to avoid fall of the shutter in case of malfunction of an element of a system carrying said screen.

BACKGROUND OF THE INVENTION

For obvious safety reasons, it is now the practice to provide vertically opening closure screens with retaining devices seeking to avoid falling of the shutter in the case of malfunction of an element of the carrying system. Moreover, in certain countries, the standards in force require providing such screens with a safety device.

As to screens provided with springs for compensating the shutter, mounted about a fixed tube, these springs are major elements adapted to undergo malfunction, and the most often present system consists in designing compensation springs integrating their own safety system in case of breakage. However, this solution has principally two drawbacks. Thus, and in the first instance, it gives rise to increase of cost of the screens because of the multiplication of the number of safety devices equal to the number of springs, and moreover it requires replacing the spring provided with its safety device upon breakage of this latter. Still further, upon breakage of a compensating spring, the shutter is blocked in the position in which it is located upon this breakage. However, the compensating springs are often disposed within the roller of the shutter and are thus not directly accessible unless the shutter is entirely taken down. In these conditions, the changing of the broken compensation spring is almost always a hazardous operation requiring frequent damage to the shutter to gain access to said spring.

As to the closure screens mounted about a rotatable tube, there exist at present a plurality of safety systems designed according to the same principle and comprising generally a member in the form of a disc or rotor adapted to be secured to the rotatable tube so as to be driven in rotation with this latter, at least one abutment member mounted pivotally on the rotor about an axis parallel to the axis of the rotatable tube, and a fixed member or stator of generally annular shape, disposed about the rotor and provided with an internal peripheral surface having recesses for blocking the free end of the abutment member.

The principle of all these safety devices consists in using the centrifugal force exerted on each pivotal abutment member, to bring this latter into a blocking position of the shutter when this centrifugal force becomes too great, corresponding to an excessive abnormal speed of unrolling of the screen.

In practice, such safety devices are quite satisfactory when they are designed to be used with closure screens of relatively low weight such as for example used for constructions in habitations. By contrast, they have drawbacks when the closure screens, for example those used for industrial buildings, have relatively great size and hence weight.

Thus, by their design, these safety devices comprise abutment members which are subjected to a phenomenon of rebound during blockage in rotation of the screen, which determines whether their effectiveness can be guaranteed.

However, in practice, overcoming this rebound phenomenon is a problem difficult to solve, as will be seen for example from a consideration of the safety device of the conventional type described in U.S. Pat. No. 5,494,093, in which the peripheral surface of the stator comprises inclined throats toward which the end of the abutment member is guided by ramps provided on said peripheral surface.

According to this design, the rebound phenomenon is avoided thanks to the conjugated shape of the end of the abutment member and the throats which thus permit obtaining wedging of said abutment member within one of the throats.

However, the wedging effort being proportional to the weight of the shutters, the use of such a safety device with shutters of relatively high weight leads either to a blockage with a great wedging effect of the abutment member within one throat, or an inelastic deformation of the stator.

In the first hypothesis, it is practically impossible to unwedge the abutment member without direct access to the safety device, and this operation requires demounting of the drive means of the rotatable shaft so as to gain access to this safety device, then dismounting said safety device which can be delicate because the latter is blocked. Moreover, during this demounting, it is frequently true that the device will be damaged, which requires its replacement.

In the second hypothesis, the stator is deformed in a residual manner and the ultimate operation of the safety device is no longer guaranteed, such that this latter must in this case also be replaced.

Another solution, described in German patent DE 24 33 544, and also applicable to screens with a rotatable tube, consists in driving in rotation with the tube counterweights adapted to pivot about axes parallel to the axis of said tube, such that one of said counterweights will become engaged in abutment teeth of a fixed plate when the centrifugal force exerted on this latter exceeds a given value determined by resilient means, in a position of blockage in which it is maintained automatically by a pawl.

According to this device, the rebound phenomenon is thus mastered by means of a pawl which ensures maintenance of the counterweight in its blocking position. However, this solution leads to the same drawback as that recited for shutters with compensation springs, namely that the shutter is blocked in the position in which it is located upon breakage of a motor element.

SUMMARY OF THE INVENTION

The present invention seeks to overcome these drawbacks and has for its essential object to provide a safety device for a closure provided with a shutter mounted about a fixed tube, permitting completely bringing down the shutter once this device is actuated.

Another object of the invention is to provide a safety device which gives rise to no wear during normal operation of the screen.

To this end, the invention provides a safety device comprising:

- a fixed disc secured about the fixed tube and having at least partially a peripheral edge provided with at least one radial opening, for blockage, with its axis lying in a vertical plane A,
- a movable disc disposed about the fixed tube relative to the fixed disc, and secured to the shutter so as to be driven in rotation with this latter,
- at least one blockage element articulated toward one of its ends on the movable plate about an axis parallel to the axis of the fixed tube, each of said blockage elements being arranged so as to be located axially in a vertical plane A and comprising a free end in the form of a claw of a shape adapted to penetrate into each radial opening of the fixed disc, and to block itself in said opening in a position in which at least one portion of said end in the form of a claw is located in prolongation of this opening radially to the outside of the peripheral edge delimiting this latter.

and associated with each blockage element, resilient means adapted:

to maintain the blockage element in one position of normal operation in which its free end moves along a circumference centered on the axis of the fixed tube, of a radius less than the radial distance between said axis and each radial opening, on this side of a predetermined centrifugal force acting on said blockage element, to permit pivoting of the blockage element so as to bring its free end to become blocked in a radial opening when the centrifugal force exceeds the predetermined threshold value.

The principle of the invention therefore consists also in using centrifugal force exerted on a blocking member associated with resilient means to bring this latter into a blocking position of the shutter when the centrifugal force becomes too great, corresponding to an excessive speed representative of breaking of a motor element.

However, the design of this safety device of which each blockage element turns with the shutter about the fixed tube, and of which one of said blockage elements becomes engaged in a radial opening of a fixed disc secured to the fixed tube with its end in the form of a claw extending in prolongation of this opening, in case of breakage of a motor element, permits controlling the rebound phenomenon without leading to any damage to said safety device. Thus, the rebound of the blockage element cannot interfere because the peripheral edge delimiting the opening in which said blockage element enters is located radially within the end in the form of a claw of this latter and therefore serves as a radial abutment preventing its pivoting toward the normal operating position. Thus, in the first instance, such a safety device has excellent reliability. Moreover, its permits, once the blockage is established, and by raising said shutter a bit, returning the blockage element into its initial position and thus being able then to pull down completely the shutter while supporting it during this descent. The broken motor element is thus located to be directly accessible and it can then easily be changed. It is to be noted moreover that one could thus equally proceed in an easy manner to any desired verification of the condition of the safety device.

Moreover, under conditions of normal operation of the screen, such a safety device has no rotatable element in contact with a fixed element such that it has no wear member.

Finally, this safety device need not be replaced and can be reused as such after breakage of a motor element.

According to another characteristic of the invention, each radial opening of the fixed disc is provided on a peripheral portion of said disc arranged to be located along the portion of the ascending path of the axis of articulation of each blockage member, in the direction of descent of the shutter.

This arrangement of each radial opening causes thus each blockage element to pivot not only under the influence of an increase of centrifugal force, but also under the influence of this additional force of the weight of said blockage element itself. Because of this, this safety device has a very rapid reaction time and can moreover be calibrated very precisely by means of a suitable loading of the elastic means.

According to another characteristic of the invention, the fixed disc is constituted of a disc having on its periphery return elements spaced perpendicular to said disc, delimiting crenelations forming blockage openings.

This design thus permits achieving, by welding of associated pieces or by bending by means of less sophisticated techniques, returns having a resulting thickness adapted to avoid any risk of deformation of these latter during activation of the safety device.

Moreover, preferably, the safety device comprises two returns disposed substantially on a quarter of the circumference of the disc extending from the lower generatrix of this latter. The presence of two successive radial blockage openings thus constitutes a double safety of blockage of the shutter.

According to another characteristic of the invention, the movable disc is constituted by a disc of a diameter substantially greater than that of the disc of the fixed disc, provided with a peripheral flange adapted to cover radially the blockage openings of said fixed disc.

Again with an aim for safety, and so as moreover to reduce to the maximum the path of the shutter, once a motor element is broken, the safety device comprises preferably at least two blockage elements whose axes of articulation are spaced symmetrically relative to the axis of the fixed tube.

Preferably, these blockage elements are three in number disposed such that their axes of articulation form summits of an equilateral triangle centered on the axis of the fixed tube.

According to another characteristic of the invention, the resilient means associated with each blockage element consists of a spring arranged to tend to pivot said blockage element in the direction of the axis of the fixed tube. Moreover, the movable disc thus has, for each blockage element, an abutment element for limiting the pivoting of said blockage element under the action of the spring.

According to another characteristic of the invention, each blockage element is provided, adjacent its end in the form of a claw, with a transverse recess adapted to cap the portion of the peripheral flange of the fixed disc delimiting an opening after pivoting of said blockage element.

Such an opening, by capping the peripheral flange of the fixed disc, forms a radial abutment for limiting the pivoting of the blockage elements.

Moreover, according to a preferred embodiment, the opening of each blockage element has a bottom wall inclined rearwardly, with respect to the direction of rotation of said blockage element, the peripheral flange of the fixed disc having at the level of each opening, a bevelled section of an inclination conjugated to that of said bottom wall.

BRIEF DESCRIPTION OF THE DRAWINGS

Other characteristics, objects and advantages of the invention will become apparent from the detailed description which follows, with reference to the accompanying drawings, which show, by way of non-limiting example, one preferred embodiment. In these drawings, which form an integral part of the present description.

DETAILED DESCRIPTION OF THE INVENTION

Figure 1:
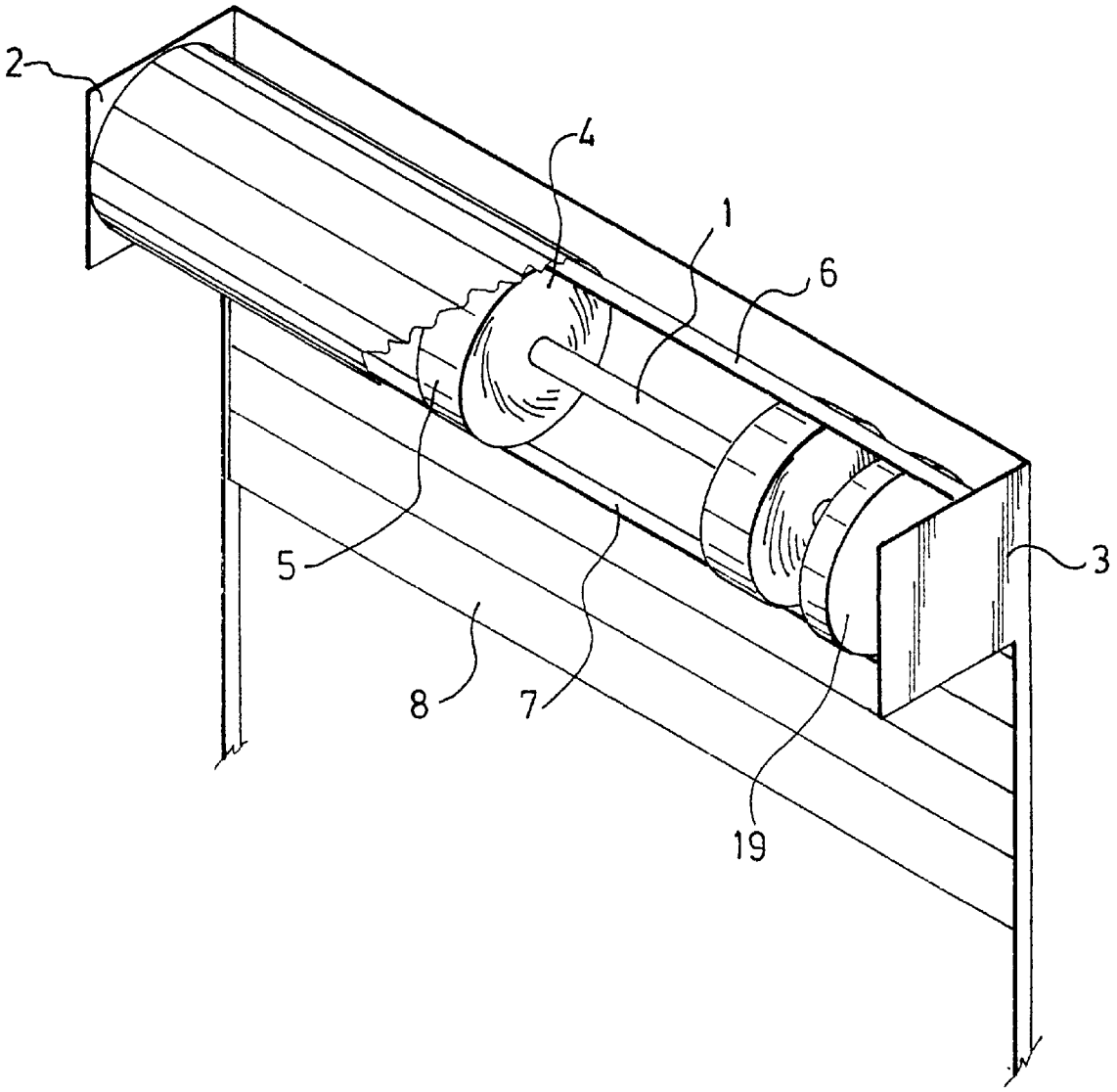
FIG. 1 is a schematic perspective view of a closure screen that can be vertically withdrawn, provided with a safety device according to the invention.
Figure 3:
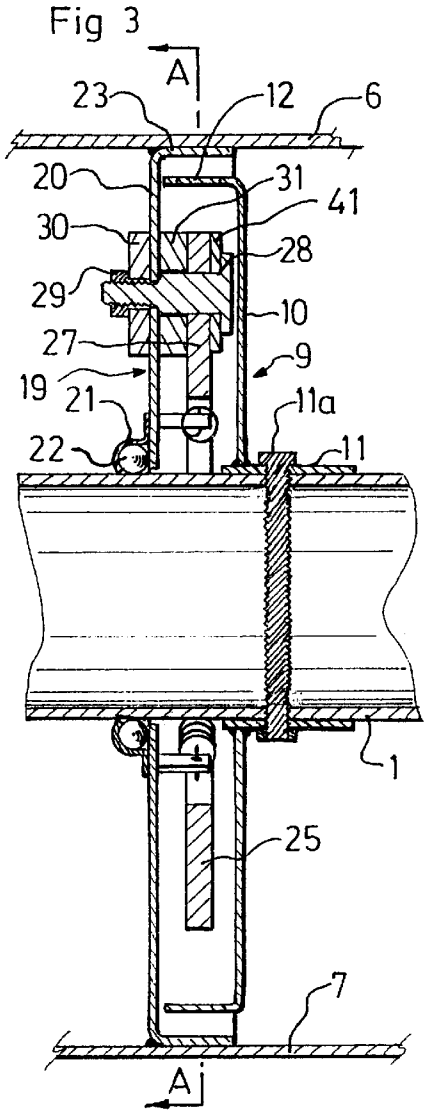
FIG. 3 is a longitudinal cross section on the plane B—B of this safety device in its non-solicited position.
Figure 2:
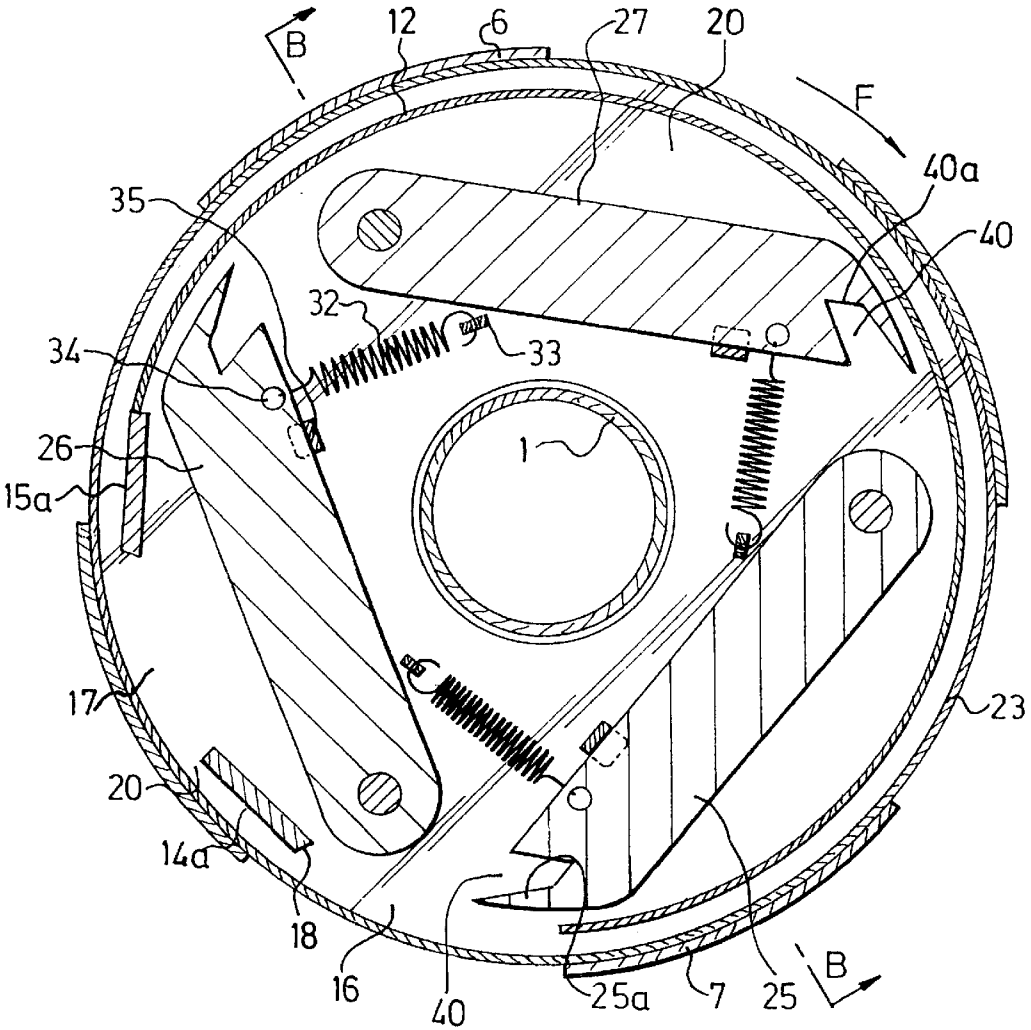
FIG. 2 is a transverse cross section on the vertical plane A—A of the safety device according to the invention, in the unsolicited position of this device corresponding to the normal operation of the screen.
Figure 4:
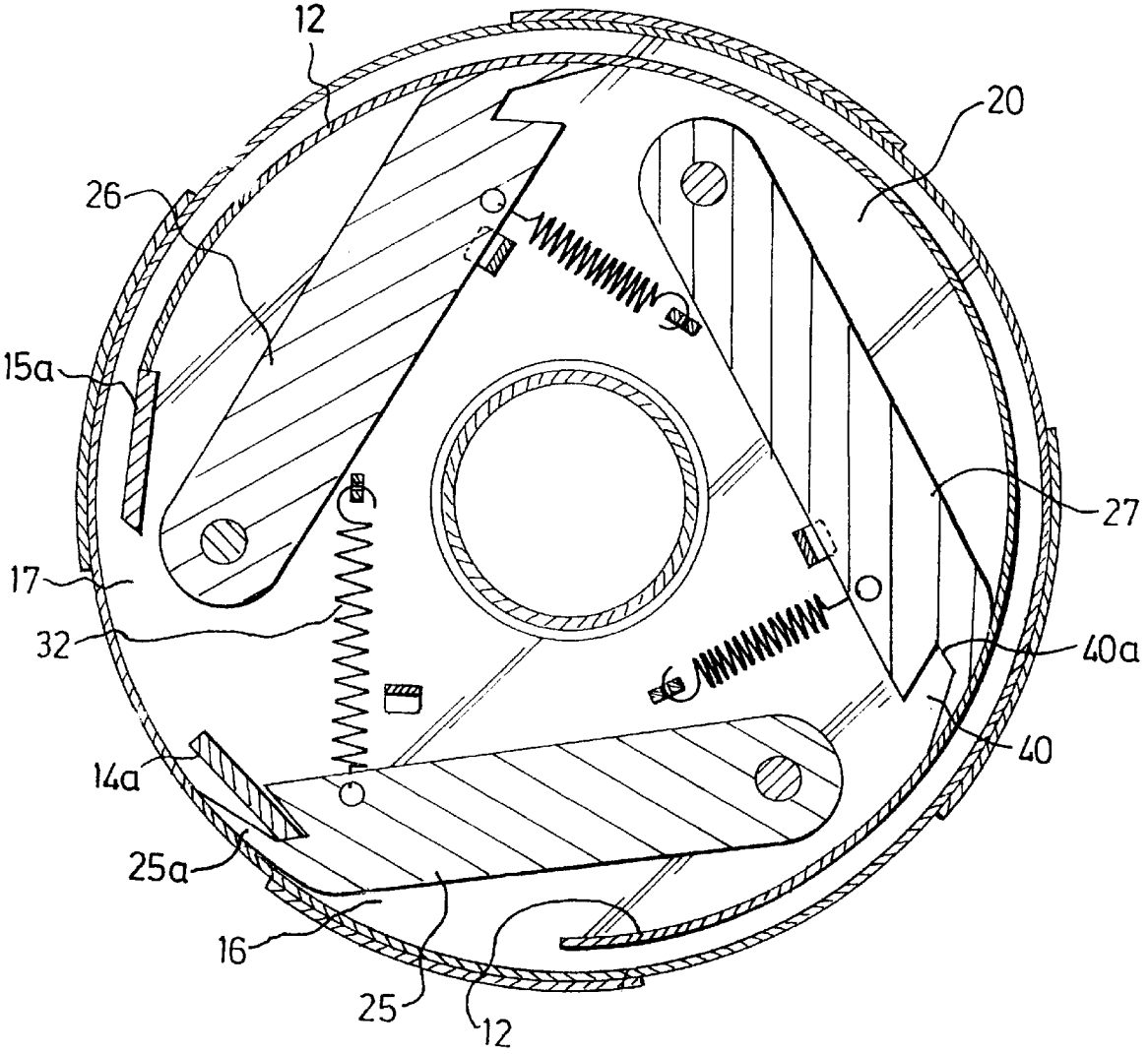
FIG. 4 is a transverse cross-sectional view on the plane A—A of the safety device in its solicited position for blocking the screen.
Figure 5:
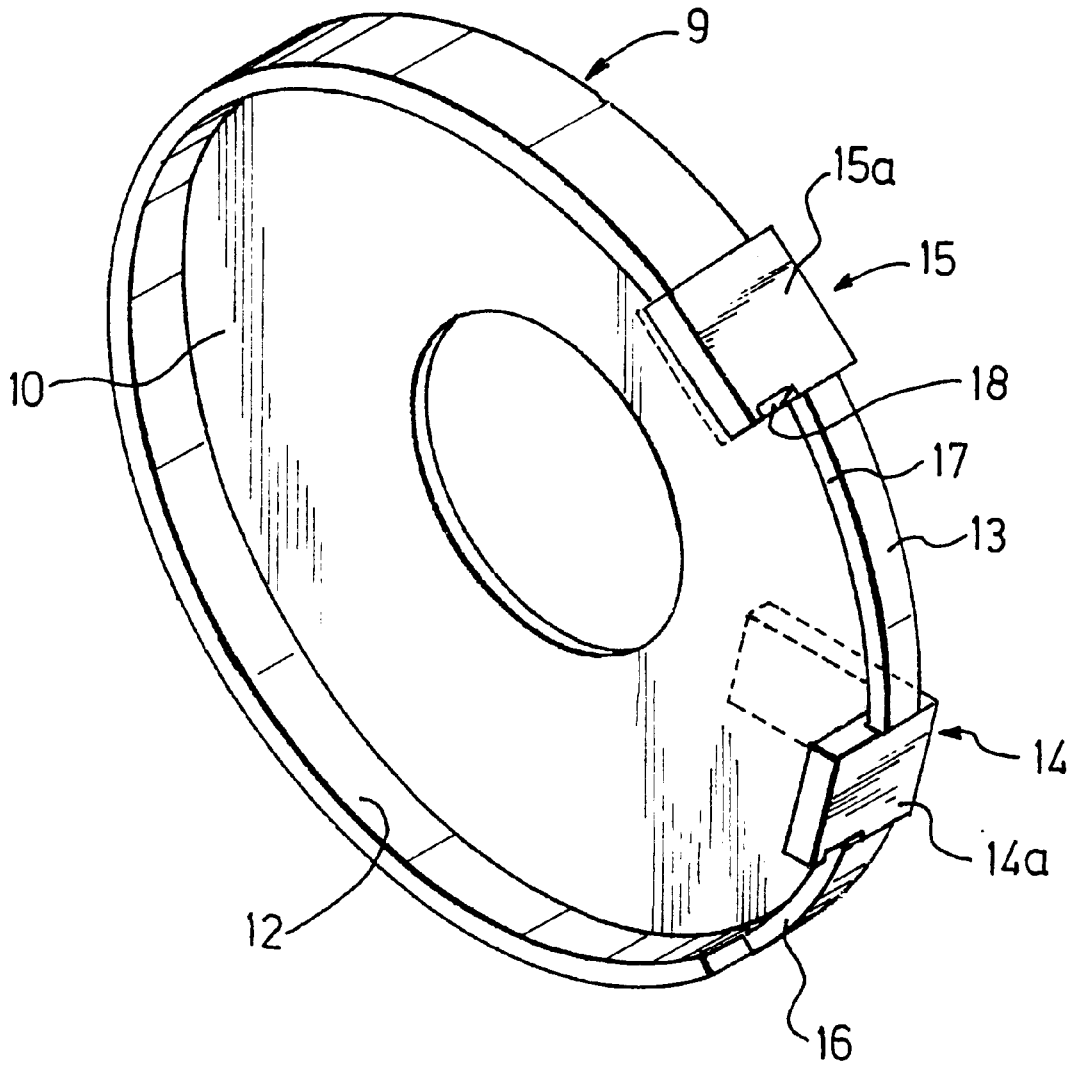
FIG. 5 is a perspective view of the fixed plate of this safety device.

The safety device according to the invention shown in FIGS. 2 to 4 is adapted to be used with a closure screen that withdraws vertically, shown schematically in FIG. 1, and comprising conventionally:

- a fixed horizontal tube 1 extending between two lateral plates 2, 3,
- compensation springs such as 4 each disposed within a bobbin such as 5 and secured to said bobbin and to the fixed tube 1,
- four convex plates such as 6, 7 for connection of the bobbins 5 welded on these latter, and to which is secured the upper end of the shutter 8.

This safety arrangement comprises in the first instance a fixed disc 9 in the form of a disc 10 pierced with a central opening of a diameter substantially greater than that of the fixed tube 1, and welded on the periphery of this opening, on a sleeve 11 of an internal diameter matching the external diameter of said fixed tube, said sleeve being pierced with diametrically opposed radial openings permitting securing it to the fixed tube 1 by means of a screw/nut assembly 11*a*. This fixed disc 9 moreover comprises a peripheral flange 12 over substantially one quarter of the circumference of said disc, a portion 13 being of lesser height. This fixed disc 9 also comprises two peripheral recesses (not shown in the figures) facing which the peripheral flange portion 13 is interrupted, said recesses being respectively provided at the level of one of the end regions and in the central region of this portion of the peripheral flange 13.

This fixed disc 9 comprises finally, two abutment members 14, 15 of L shape of which one of the legs is welded on the external surface of said fixed disc, and of which the other leg 14*a*, 15*a* is disposed in a recess, so as to form an abutment of a height greater than that of the peripheral flange 12, delimiting with this latter respectively two radial openings 16, 17. Moreover, the lateral surface of said leg 14*a*, 15*a*, of abutment of the blockage elements, has a recess 18 of triangular section, provided so as to be located on the path of said blockage elements.

Moreover, as shown in FIGS. 2 and 4, the fixed disc 9 is disposed such that the portion of the peripheral flange 13 extends, from the lower generatrix of the disc 10, into the left quadrant portion of said disc, taken in the direction of descent of the shutter shown by the arrow F.

The safety device also comprises a second movable disc 19 arranged to be welded or fixed by means of bolts on the internal surface of the convex plates 6, 7 for connection of the bobbins 5, so as to be driven in rotation with these latter and the shutter 8, and disposed facing the fixed disc 9 so as to form a frame with this latter.

This movable disc 19 also has the shape of a disc 20 pierced with a central opening permitting mounting about the fixed tube 1. Moreover, a roller ball cage 22 is interposed between the fixed tube 1 and the disc 20, and maintained on this latter by means of a plate 21 forming an external cage.

This movable disc 19 also comprises a peripheral cylindrical flange 23 obtained by bending so as to radially cover the peripheral flange 12 of the fixed disc 9, and to be secured to the convex plates 6, 7.

This movable plate 19 is moreover provided with three blockage knives 25, 26, 27, which are rectilinear and provided with a thin forward end in the shape of a claw such as 25*a*. Each of these blades 25–27 also comprises a transverse recess 40 terminating its end portion in the shape of a claw 25*a* and adapted to receive the branch 14*a*, 15*a* of the abutment members 14, 15 during blockage of the device. This recess 40 moreover has an inclined bottom wall 40*a* conjugated with the recess 18 of the abutment members 14, 15.

These blades 25–27 are mounted on the disc 20, in line with their rear end, by means of axes of articulation consisting for each of said blades, and as represented in FIG. 3, as a screw 28/nut 29 system and by three rings 30, 31, 41 interposed on opposite sides of said disc and said blades.

As shown in the figures, the axes of articulation of the blades 25–27 are uniformly distributed over the disc 20 and form the summits of an equilateral triangle centered on the axis of said disc, such that said blades extend according to chords of this latter, their claw 25*a* being located a short radial distance, of the order of 2 millimeters, from the peripheral flange 12 of the fixed disc 9.

So as to ensure maintenance of the blades 25–27 in this angular position, each of the latter is moreover associated with:

- a spiral spring 32 extending orthogonally relative to said blade and whose end claws are engaged respectively in an eyelet 33 secured to the disc 20 and in an opening 34 provided in each blade 25–27 a short distance from the claw 25*a*,
- an abutment 35, obtained by cutting out and bending small portions of the surface of the disc 20, and arranged so as to be disposed to the rear of said claw 25*a* of each blade 25–27.

As shown in FIG. 2, during normal operation of the screen, which is to say for normal speeds of unrolling of the shutter 8, in the direction of arrow F, the blades 25–27 are maintained in contact against the abutments 35 under the influence of springs 32. It is to be noted moreover that under these conditions of operation, no rotating element is in contact with any fixed element such that there exists no risk of wear.

By contrast, in the case of an incident and increase in the speed of unrolling beyond a predetermined value which can be easily calculated by adjustment of the load on the springs 32, the blades 25–27 pivot about their axis of articulation and one of said blades, for example the blade 25, comes in the first instance to slide along the portion of the peripheral flange 13, in the radial opening 16, then to abut against the abutment member 14, the second abutment member 15 being provided only to increase safety.

Upon this contact between the blade 25 and the abutment member 15, the recess 40 receives the branch 14*a* of this abutment member at the level of the recess 18 such that the bottom wall 40*a* of this recess 40 absorbs the first shock of abutment. The second abutment shock is as to itself borne by the transverse wall adjacent this recess 40 which becomes radially applied against the abutment member 14 and limits by the latter the pivoting of the knife 25. Finally, and in an essential manner, any risk of rebound is cancelled by the fact that the end in the form of a claw 25*a* of the knife comes to slide radially along the outside of the abutment member 14.

Another safety criterion guaranteeing the blockage of the shutter 8, resides in the fact that the abutment members 14, 15 are disposed along the portion of the ascending path of the axes of articulation of the blades 25–27, if it is considered that the direction of unrolling is F. Because of this fact, thus, the weight of the blades 25–27 adds to the centrifugal force and therefore promotes the pivoting of these latter.

In the last place, one of the principal advantages of the safety device according to the invention resides in the fact that, once the shutter 8 is blocked, as shown in FIG. 4, the blade 25 can be unblocked very simply by raising somewhat said shutter, and this latter can then be permitted to descend completely, under manual control, thereby permitting direct access to the winding system (spring compensators 4 . . .).

I claim:

1. A safety device for closing a shutter mounted about a fixed tube, the safety device comprising:

a fixed disc secured about the fixed tube and having at least partially a peripheral flange provided with a plurality of radial openings, for blockage, with its axis lying in a vertical plane;

a movable disc disposed about the fixed tube and facing the fixed disc, said movable disc structured and arranged to be secured to and driven in rotation by the shutter;

a plurality of blockage elements, each blockage element being articulated at one of its ends on the movable disc about an axis parallel to the axis of the fixed tube, each blockage element being arranged to be located axially in the vertical plane and comprising a free end having the shape of a claw adapted to penetrate into each radial opening of the fixed disc and to become blocked in said opening in a position in which at least one portion of said free end is located as an extension of said radial opening outside the peripheral flange delimiting said radial opening;

each blockage element having resilient means structured and arranged:

to maintain the blockage element in a normal operating position in which its free end moves about a circumference centered on the axis of the fixed tube of a radius smaller than the radial distance between said axis and each radial opening, within a predetermined centrifugal force urging the blockage element; and to pivot the blockage element so as to block its free end in a radial opening when the centrifugal force exceeds a predetermined threshold value.

2. The safety device according to claim 1, wherein each radial opening of the fixed disc is provided on a peripheral portion of said fixed disc and is located along a portion of an ascending path of the articulation axis of each blockage member, in a descending direction of the shutter.

3. The safety device according to claim 2, wherein the fixed disc has on its periphery spaced return elements perpendicular to said fixed disc, delimiting crenelations forming the radial openings.

4. The safety device according to claim 3, wherein two spaced return elements are disposed substantially on a quarter of the circumference of the fixed disc extending from a lower generatrix of said fixed disc.

5. The safety device according to claim 3, wherein the movable disc has a diameter substantially greater than that of the fixed disc, and a peripheral flange arranged to radially cover the radial openings of the fixed disc.

6. The safety device according to claim 1, wherein said device comprises two blockage elements whose articulation axes are distributed symmetrically relative to the axis of the fixed tube.

7. The safety device according to claim 1, wherein the device comprises three blockage elements whose articulation axes are distributed symmetrically relative to the axis of the fixed tube.

8. The safety device according to claim 1, wherein each blockage element has adjacent its free end a transfer recess adapted to cap a portion of the peripheral flange of the fixed disc delimiting a radial opening after pivoting of said blockage element.

9. The safety device according to claim 8, wherein the recess of each blockage element has a bottom wall inclined rearwardly relative to the direction of rotation of said blockage element, the peripheral flange of the fixed disc having at each radial opening a beveled section of an inclination matching that of the bottom wall.

10. The safety device according to claim 8, wherein the resilient means consist of a spring arranged to urge the blockage element to pivot in the direction of the axis of the fixed tube, and the movable disc has, for each blockage element, an abutment element for limiting the pivoting of the blockage element.

* * * * *